United States Patent [19]

Aiba et al.

[11] 4,340,464

[45] Jul. 20, 1982

[54] METHOD FOR THERMAL CRACKING OF HEAVY PETROLEUM OIL

[75] Inventors: Takaaki Aiba; Hisatsugu Kaji; Tomizo Endo; Takao Ishihara, all of Ichihara, Japan

[73] Assignees: Kureha Kagaku Kogyo Kabushiki Kaisha, Tokyo; Sumitomo Metal Industries, Ltd., Osaka; Sumikin Coke Co., Ltd., Wakayama, all of Japan

[21] Appl. No.: 112,920

[22] Filed: Jan. 17, 1980

Related U.S. Application Data

[63] Continuation-in-part of Ser. No. 888,393, Mar. 20, 1978, abandoned.

[51] Int. Cl.[3] ..... C10C 3/00; C10C 3/04

[52] U.S. Cl. ..... 208/40

[58] Field of Search ..... 208/40

[56] References Cited

U.S. PATENT DOCUMENTS

| | | | |
|---|---|---|---|
| 2,234,910 | 3/1941 | Barron | 208/48 R |
| 2,416,023 | 2/1947 | Schulze et al. | 208/130 |
| 2,813,824 | 11/1957 | Gorin | 208/40 |
| 3,928,170 | 12/1975 | Takahashi et al. | 208/40 |
| 4,080,283 | 3/1978 | Noguchi et al. | 208/40 |

FOREIGN PATENT DOCUMENTS

| | | | |
|---|---|---|---|
| 332913 | 7/1930 | United Kingdom | 208/48 R |

*Primary Examiner*—Delbert E. Gantz
*Assistant Examiner*—Helane E. Maull
*Attorney, Agent, or Firm*—Wegner & Bretschneider

[57] ABSTRACT

Disclosed is a method for the thermal cracking of a heavy petroleum oil to produce a pitch with a high aromaticity having a high softening point, the ratio of H/C of about 0.4 to 1.1 and the fraction insoluble in n-heptane but soluble in quinoline of higher than 55% by weight and an oil mainly composed of aliphatic hydrocarbon by feeding the heavy petroleum oil into a reaction system and bringing it therein into contact with a gas which does not react with the heavy petroleum oil, of a temperature in the range of from 400° C. to 2000° C., which method is improved by using, as the reaction system, a plurality of reaction vessels arranged in series and having their interior temperatures successively lower by a fixed step in the direction of the transfer of the charge.

3 Claims, 5 Drawing Figures

*Schematic Flow Chart of a Model of the Reaction System of the Present Invention.* where $n$: the number of reaction vessels $F$: flow rate ($m^3$/hour)

$V_i$: fluid volume in a reaction vessel of a plurality of reaction vessels of the total number of $i$.

wherein $i \times V_i$ = constant = $V_1$ and average residence time $= \frac{i \times V_i}{F} = \frac{V_1}{F} = 1$ (hour)

FIG. 2 Results of calculation of the distribution of average residence time.
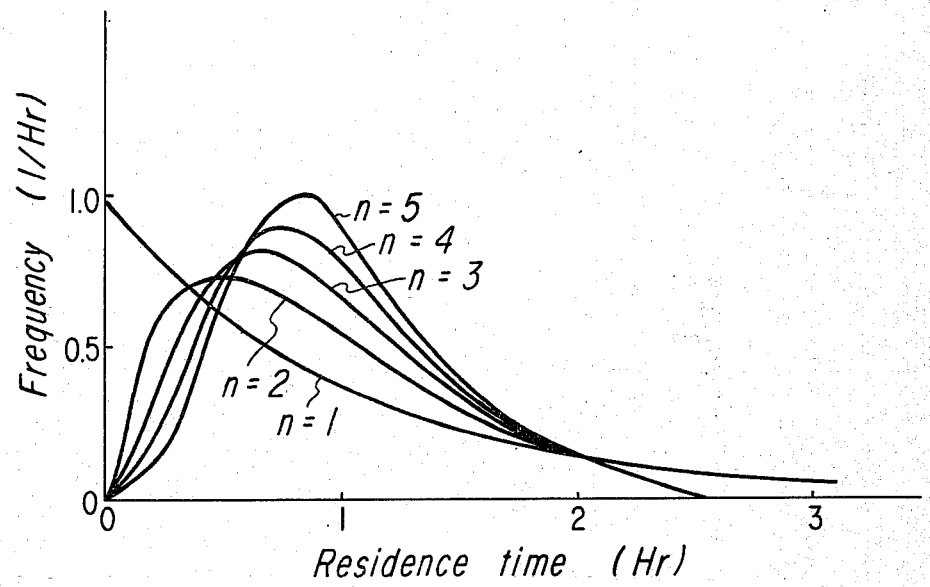
FIG. 3 A Graph showing the relationship between the coking troubles and the rection conditions.
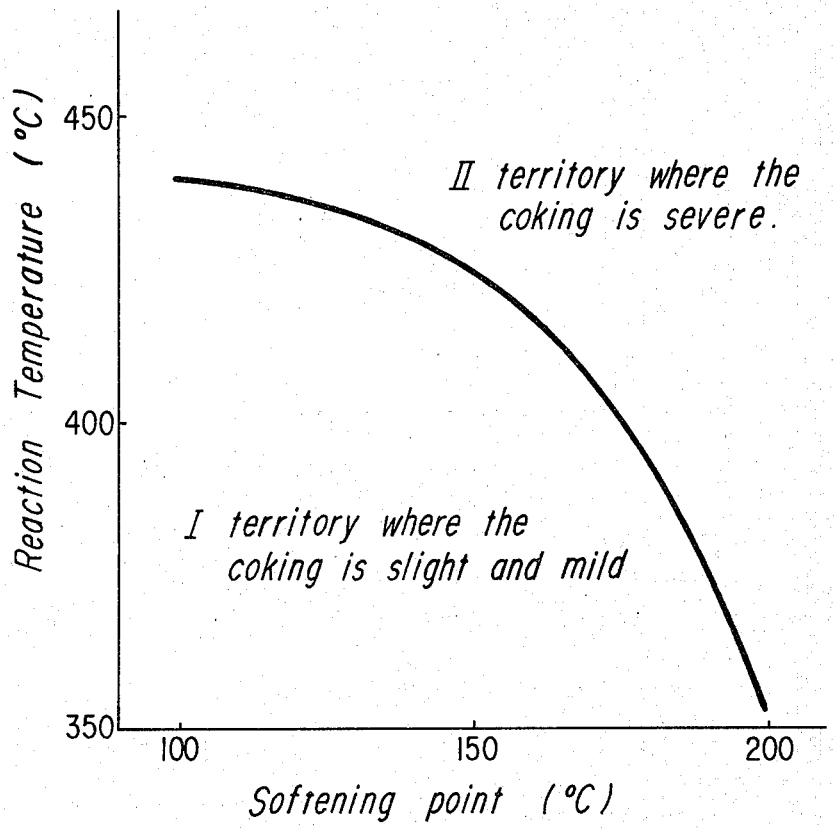

*Relationship between the Softening Point of Pitch and the Number of Reaction Vessels arranged in Series.*

*Process Flow Chart of Thermal Cracking of Heavy Petroleum Oil according to the Present Invention.*

METHOD FOR THERMAL CRACKING OF HEAVY PETROLEUM OIL

CROSS-REFERENCE TO RELATED APPLICATION

The present application is a continuation-in-part of application Ser. No. 888,393 filed Mar. 20, 1978 now abandoned.

SUMMARY OF THE INVENTION

In an aspect of the invention, there is provided a method for advantageous thermal cracking of a heavy petroleum oil, which method causes the thermal cracking to proceed moderately and thereby affords pitches having high aromaticity, a high softening point and the fraction not soluble in n-heptane but soluble in quinoline of more than about 55% by weight, and uniform in quality, in other words not containing too much of low-boiling fractions and of extremely hard fractions, and aliphatic hydrocarbon oil in high yields without causing coke-formation on the inner walls of the cracking reactor and in the pitch product.

BRIEF DESCRIPTION OF THE DRAWING

In the accompanying drawings:

FIG. 2 is the results of calculation on the residence time of the reactants in a series of reaction vessels based on the above-mentioned model of the reaction system, FIG. 3 shows the relationship between the reaction conditions of thermal cracking and the coking troubles.

DETAILED DESCRIPTION OF THE INVENTION

Figure 1:
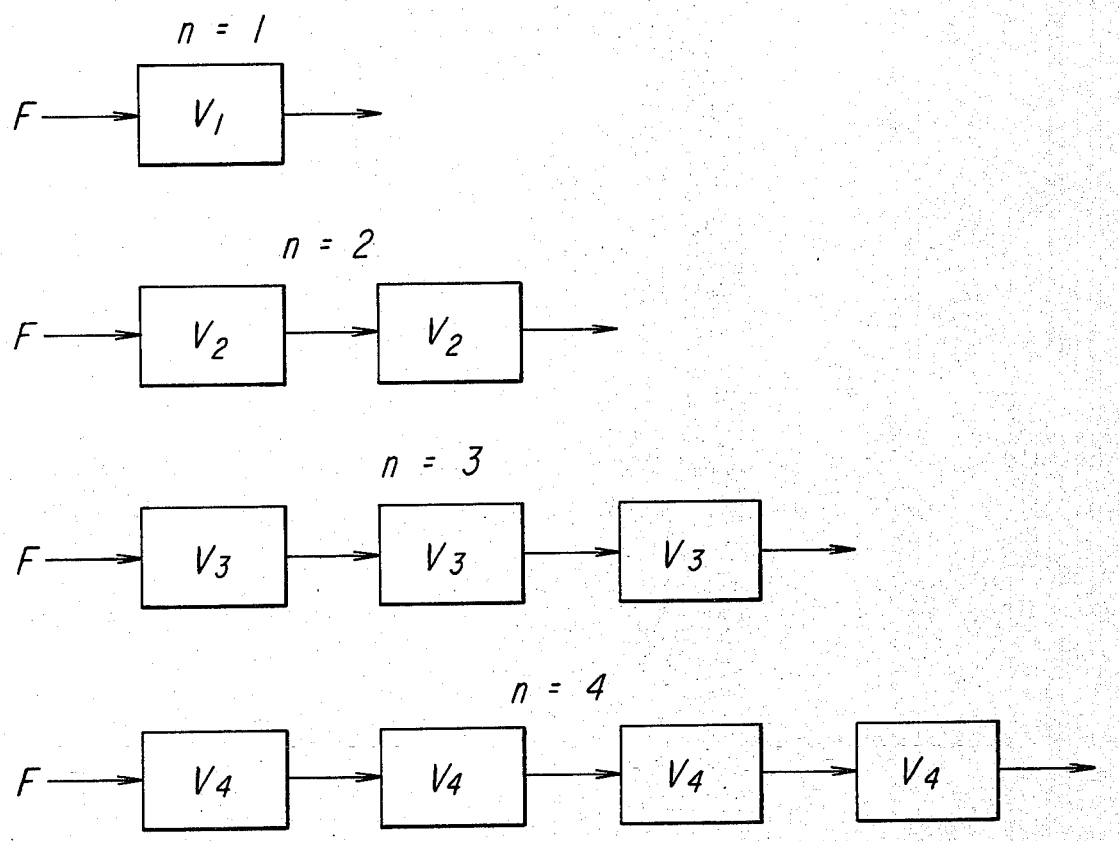
FIG. 1 is the schematic flow chart of a model of the reaction system of the present invention.

The present invention concerns an improved method for the thermal cracking of a heavy petroleum oil to produce among others a pitch with a high aromaticity having a high softening point, the ratio of H/C of about 0.4 to 1.1 and the fraction insoluble in n-heptane but soluble in quinoline of higher than 55% by weight, suitable for use as the binder for manufacturing the cokes for steel production.

There have heretofore been suggested various methods for thermally cracking a heavy petroleum oil. In particular, among those for the production of a pitch suitable for making cokes for use in steel manufacturing, having a high aromaticity, a high softening point, the ratio of H/C of about 0.4 to 1.1 and the fraction insoluble in n-heptane but soluble in quinoline of higher than 55% by weight, there is disclosed in U.S. Pat. No. 3,928,170, in which a gas not reacting with the heavy petroleum oil, of a temperature of 400° to 2000° C., is brought into contact with the heavy petroleum oil to crack the heavy petroleum oil thermally at a temperature of lower than 500° C., thereby obtaining hydrocarbon gases, aliphatic hydrocarbon oils and the above-mentioned aromatic pitches. To be more specific, the heavy petroleum oil is heated to a temperature of 450°-520° C. and the thus heated oil is introduced into a reactor wherein the oil is brought into contact with a gas at a temperature of 400° to 2000° C. to cause the thermal cracking at a temperature of 350° to 450° C., preferably of 400° to 440° C.

This method, however, has a disadvantage that the aromatic hydrocarbon pitches produced suffer in quality by unwanted incorporation therein of a substance approximating the raw material and coked substances resulting from excessive thermal cracking of the raw material.

In the present invention, the heavy petroleum oil is successively introduced into the plurality of reaction vessels arranged in series and is brought into contact, inside the reaction vessels, with the gas kept at a temperature in the range of from 400° to 2000° C., with the interior temperatures of the reaction vessels so adjusted that they are each lower than that of the preceding reaction vessel by a step of not less than 3° C. For example, the thermal cracking of the heavy petroleum oil aimed at by this invention can be carried out by preparatorily heating the heavy petroleum oil in a heating furnace to a temperature in the range of from 450° to 520° C., delivering the preheated heavy petroleum oil into the first reaction vessel, and allowing the oil to undergo thermal cracking in the other reaction vessel at successively decreasing reaction temperatures in the range of from 350° to 450° C. under a pressure in the range of from 300 mm Hg Abs. to 15 kg/cm$^2$ G for an overall retention time of from 1 to 10 hours. The interior temperatures of these reaction vessels can be adjusted, for example, by properly controlling the volumes of the gas having a temperature of from 400° to 2000° C. introduced into the respective reaction vessels. It is also necessary that the interior temperatures of these reaction vessels should be successively lower each by a step of not less than 3° C., preferably by a step in the range of from 5 to 50° C. Although the number of such reaction vessels to be used for the present thermal cracking is not specifically limited, it is generally preferred to be in the range of from 2 to 5.

The heavy petroleum oils which are usable for the present invention include all the products of petroleum refinery classified as heavy distillates and residues such as, for example, residues from atmospheric distillation, residues from vacuum distillation, residues from thermal cracking, slurry oil from catalytic cracking and various refinery residues. These heavy petroleum oils generally are composed predominantly of components having boiling points not lower than 350° C. The gas which is used for contact with the heavy petroleum oil inside the reaction vessels has only to satisfy the requirement that it should remain stable at the reaction temperature, avoid reaction with the heavy petroleum oil under treatment, function as an effective heat medium for the heavy petroleum oil and accelerate thermal cracking of the oil. Examples of the gases which are usable for this purpose include inert gases such as nitrogen and argon; steam; and complete combustion gases containing substantially no oxygen.

In the followings, the meanings of the three important technical points of the present invention are explained in detail; the three important technical points being (1) blowing a heated gaseous thermal medium not reacting with the heavy petroleum oil into the oil, (2) successively using a series of reaction vessels in number of 2 to 5 arranged in series and (3) the reaction temperature in one of the reaction vessels arranged in series is maintained lower than that of the preceding reaction vessel by 5° to 50° C.

The three important technical points have been devised for the following objects of the present invention:

(1) to suppress the formation and the propagation of coke in each reaction vessel, (2) to obtain a highly aromatic and homogeneous pitch of high softening temperature, of the ratio of H/C of 0.4 to 1.1 and of the fraction insoluble in n-heptane and soluble in quinoline of higher than 55% by weight, and (3) to avoid the run-away of the reaction of cracking and polycondensing and to maintain the stabilized reaction.

The above-mentioned highly aromatic pitch aimed at by the present invention is quite suitable as a binding agent for non-caking or slightly-caking coal in the preparation of cokes for use in steel industry. The blowing of a heated gaseous thermal medium not reacting with the heavy petroleum oil is for the supply of the necessary heat in the reaction of cracking and polycondensing, for driving out the aliphatic hydrocarbon which is one of the reaction product and for the agitation of the reaction mixture, the driving out the aliphatic hydrocarbon, particularly affecting directly the yield and properties of the produced pitch.

The product of the thermal-cracking of heavy petroleum oil should be separated to a cracked gas, a cracked oil and a cracked pitch, and in the case of separation, by the rapid driving out the cracked oil from the reaction mixture it is possibly to avoid the excessive proceeding of the polycondensation of the cracked oil not only for improving the yield of the cracked oil but also for avoiding the formation of mixture of lower molecules of the cracked oil and coke-like substance produced by the excessive reaction.

The meaning of using successively the two to five reaction vessels arranged in series is, as will be explained in detail later, to obtain the highly aromatic and homogeneous pitch, however, the above-mentioned object (3) is achieved at the first time, by the adoption of such a system comprising two to five reaction vessels arranged in series and of the specified operation conditions of the present invention.

In order to obtain the high aromatic pitch of the object of the present invention, it is important to produce the hard pitch by promoting the polycondensation as far as possible in the range of treating the pitch as a liquid at a temperature of 250° to 450° C. mainly from the reason of production including transfer and to make narrow the distribution of reaction time within the reaction mixture. Petroleum pitch is usually a mixture of substances which differ in its own reaction history, in other words, differ in its degree of proceeding of reaction, and in an extreme case it is a mixture of unreacted substance and excessively reacted substance not to be utilized as it is. Accordingly, in order to produce a homogeneous pitch it is very important to make the degree of proceeding of reaction uniform, and for that purpose, it is far superior of providing two to five reaction vessels arranged in series to the provision of only one reaction vessel in which a complete mixing is carried out.

In order to understand the above-mentioned superiority, a little lengthy explanation will be given below using a simplified model of reaction system.

For simplification, it is assumed that the temperatures of the reaction vessel arranged in series are the same, and accordingly, the degree of proceeding of reaction can be represented only by the length of reaction time and the uniformity of the degree of proceeding of reaction can be compared by the distribution of the length of reaction time.

Calculation of the distribution of the length of time of reaction was carried out on the two representative cases, one of which is the case of only one reaction vessel of complete mixing and the other of which the case of a plurality of reaction vessels (two, three and four) arranged in series. In both cases, however, the average residence time in each reaction system is all the same, that is, one hour, in order that the final product, pitch has almost the same softening point.

FIG. 1 of the attached drawing illustrates the model of reaction system. In FIG. 1, $V_i$ means the reaction vessels and "i" is the number of reaction vessels of each system. For instance, $V_4$ shows that the system comprises four reaction vessels arranged in series through which the petroleum oil flows at a rate of F ($m^3$/hour). $V_i$ also represents the volume of the petroleum oil in the reaction vessel.

FIG. 2 shows the results of calculation on the distribution of residence time of the reaction mixture in each system, which is considered to be the same as the distribution of degree of proceeding of reaction, because the temperature is all the same in each reaction system. As is seen in FIG. 2, in reaction vessels arranged in series, the number of reaction vessels becomes larger, the distribution of the residence time (distribution of degree of proceeding of reaction) becomes narrower. It means that the product, the pitch, becomes more in uniform (containing less amount of unreacted raw oil and also less amount of overreacted pitch). The results of calculation was verified by Examples described later.

In the next place, the problems of formation and propagation of coke and of the run-away of the reaction of cracking and polycondensation are described in connection with the operation in which the reaction temperature in a reaction vessel is maintained lower than that in the preceding reaction vessel by 5° to 50° C.

Coke particles once formed mainly from a quinoline-insoluble product grow in the reaction mixture and adhere to the inner wall of the reaction vessel and then still grow thereon. Coke formation and propagation rapidly proceeds at a higher reaction temperature and in a pitch having a higher melting point. FIG. 3 shows the territory (II) in which the coke formation and propagation are observed violently and the territory (I) in which the phenomenon is moderate, by the reaction temperature and the softening point of the pitch, FIG. 3 having been obtained by the inventor's own actual operation of petroleum oil cracking. As is seen FIG. 3, in order to produce a high aromatic pitch of higher softening point while avoiding the formation and propagation of coke particles, it is necessary to operate the reaction in the territory of (I). In such a case, when only one reaction vessel is used, the reaction must be carried out at a very low temperature and accordingly the reaction period, that is, the residence time in the reaction vessel should be very long. For that purpose, a large reaction vessel becomes necessary.

On the quite contrary in the plurality of reaction vessel arranged in series, for instance, three reaction vessels, since the petroleum oil in the first and the second reaction vessels have not so much experienced the thermal history, the reaction temperature in these vessels can be maintained relatively higher and the rate of reaction can be maintained relatively larger. Accordingly, the total average residence time can be shortened and the volume of each reaction vessel can be smaller.

In short, by providing the plurality of reaction vessels arranged in series, it has become possible to produce a high aromatic pitch of higher softening point while avoiding the adhesion and propagation of coke onto the inner wall of the reaction vessels having a relatively smaller volume.

In addition, the inventor has found a following empirical formula concerning the petroleum oil cracking technology:

$$k = 1.32 \times 10^{16} \times e^{-\frac{50500}{RT}}$$

wherein

R represents the gas constant = 1.987 kcal/kg-mol°K., and

T represents the reaction temperature, °K.

According to the formula, the raising of reaction temperature by 10° C. in the neighborhood of 400° C. causes the raising of the rate constant of the reaction by 1.8 times. It means that the necessary volume of the reaction vessels is possibly reduced by raising the reaction temperature in the safety territory of (I). Also it will be understood that the reduction of the reaction temperature when the softening point of the reaction mixture becomes considerably higher is very effective for controlling the reaction rate in that time.

In the next place, the control of the run-away of cracking and polycondensation is described. It is said that in the actual operation of thermal cracking of petroleum oil to produce a pitch of high softening point, a certain degree of fluctuation of the softening point of the produced pitch is inevitable, and when an excessive reaction takes place the pitch becomes to hard to be transferred. The relationship between the softening point and the viscosity of the pitch at 300° C. is as follows:

| Softening point (°C.) | Viscosity at 300° C. (poise) |
|---|---|
| 160 | 2.6 |
| 180 | 20 |
| 200 | 250 |

As is shown above, only one degree of fluctuation of softening point makes about 20% of the fluctuation of the viscosity, and accordingly the management of the softening point is absolutely necessary for the production of pitch for long period of operation.

The meaning of providing a plural number of reaction vessels arranged in series and keeping the reaction temperature in each reaction vessel lower than that of the preceding reaction vessel by 5° to 50° C. is to suppress the adhesion and propagation of coke in the reaction vessel and also to avoid the run-away of the reactions of cracking and polycondensation.

Figure 4:
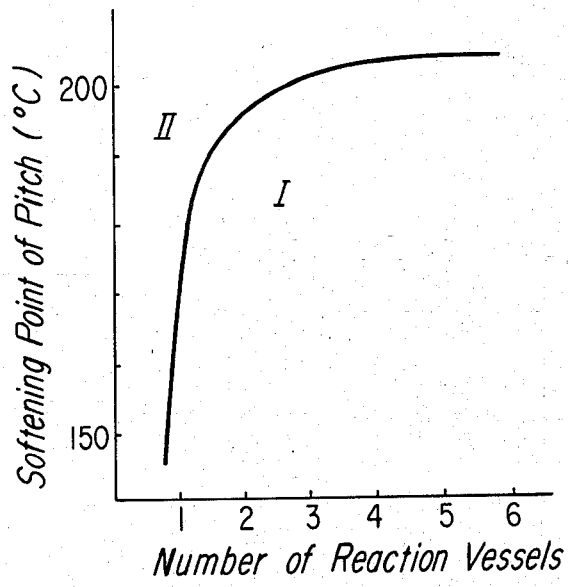
FIG. 4 shows the relationship between the softening point of the pitch produced and the number of reaction vessels used for cracking of the heavy petroleum oil in accordance with the present invention.

The inventor has found after experiments carried out under various conditions that in order to operate the system without causing the inability to transfer the pitch by excess raising of the softening point, it is safe to have reactions carried out in the range illustrated by (I) in FIG. 4. By reducing the reaction temperature by 5° to 50° C., the rate of reaction becomes 0.7 to 0.07 times lower, and accordingly the control of rate of reaction becomes easier.

Figure 5:
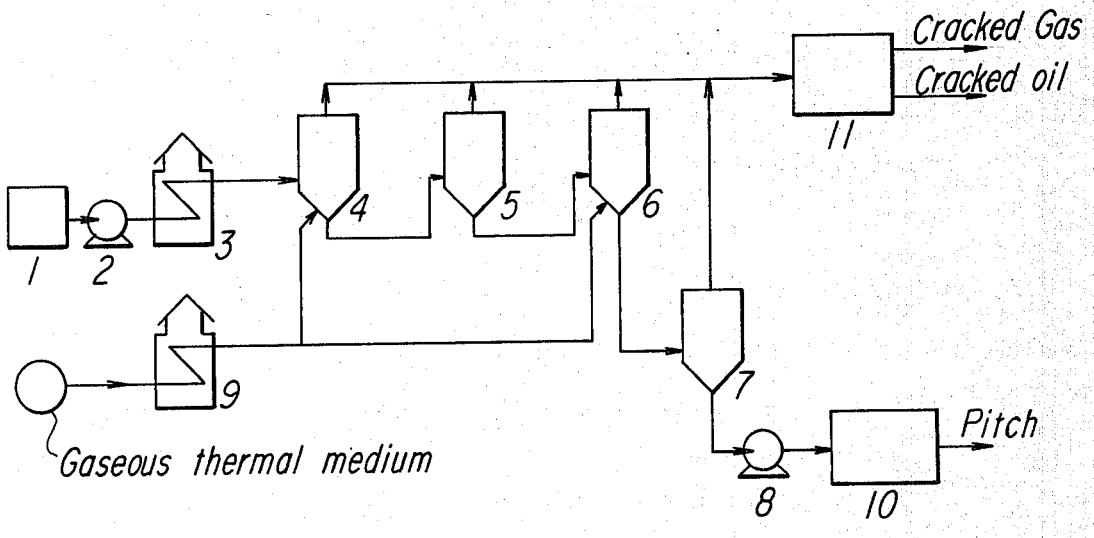
FIG. 5 is a flow chart illustrating one preferable embodiment of the operation of thermal cracking of the heavy petroleum oil in accordance with the method of the present invention.

The process of the present invention is explained referring to FIG. 5.

The raw material, heavy petroleum oil, is continuously transferred from a raw material tank 1 into a tubular heating furnace 3 by means of a pump 2. In the heating furnace 3, the feed oil is heated to a temperature in the range of from 450° to 520° C. and then forwarded continuously to the first reaction vessel 4. The oil in the first reaction vessel 4 is further forwarded continuously into the second reaction vessel 5 and then into the third reaction vessel 6. During the travel through the successive reaction vessels, the oil is gradually converted into a pitchy mass due to the thermal cracking reaction. The pitchy mass is received in a pitch cooling tank 7 and cooled to a temperature in the range of from 300° to 350° C. so as to terminate the thermal cracking reaction. The pitchy mass kept in a liquid state in the pitch cooling tank 7 is continuously forwarded through the bottom of the tank to a storage unit 10 by way of a pump 8.

The heat-transfer gas, heated in advance in the furnace 9, is continuously blown into the respective bottoms of reaction vessels 4, 5 and 6 to supply the heat for the reaction of cracking and for distillation of cracked oil formed by cracking.

Generally, the operating conditions for the reaction vessels 4, 5 and 6 are 350° to 450° C., 300 mm Hg Abs. to 15 kg/cm$^2$ G of pressure and 1 to 10 hours of overall retention time. Preferable operating conditions are 380° to 440° C., 0 to 2 kg/cm$^2$ G of pressure and 1 to 5 hours of overall retention time. The regulation of the overall retention time can be accomplished by causing the liquid under treatment to be continuously transferred at a suitably controlled rate from one reaction vessel to another and thereby keeping constant the levels of liquid within the respective reaction vessels.

The regulation of the operating temperatures within the reaction vessels 4, 5 and 6 can be accomplished by properly adjusting the temperature of the oil at the outlet of the heating furnace 3 in the range of from 450° to 520° C. and the temperature of the heat-transfer gas being blown into the reaction vessels in the range of from 400° to 2000° C.

What should be noted at this point is that the temperatures of the reaction vessels in the series should be successively lower than that in the preceding reaction vessel, each by a step of not less than 3° C., preferably a step in the range of from 5° to 50° C. and as is shown in (I) of FIG. 3.

Of the products forming in the course of the cracking reaction, the light distillates are expelled out of the upper ends of the reactor vessels 4, 5 and 6 in the form of vapor with the heat-transfer gas being blown upwardly into the reaction vessels. The expelled light distillates are forwarded to a fractional distillation unit 11, there to be divided into cracked gas and cracked oil.

One of the remarkable characteristics of this invention is that the interior temperature of the second reaction vessel should be lower than that of the first reaction vessel. This is essential because the pitchy mass in the second reaction vessel is more liable to be coked than in the first reaction vessel and, in order to prevent this unwanted coking from occurring, the temperature inside the second reaction vessel must be lower than that in the first reaction vessel. As is readily understood, therefore, the interior temperature of the third reaction vessel must be lower than that of the second reaction vessel by the same token. Particularly important in this respect is the fact that, in the plurality of reaction vessels arranged in series, the interior temperatures of the individual reaction vessels should each be lower in the direction of the transfer of the charge, each by a step of not less than 3° C., preferably by a step in the range of from 5° to 50° C.

According to the above-mentioned new technique of the present invention, pitches having high aromaticity and high quality are consistently obtained and, at the same time, distillates of excellent quality are produced. Further, from the operational point of view, the present invention offers an advantage that the reaction vessels effectively function with relatively small inner volumes and the heat-transfer gas sufficiently fulfils its role even when used in a small amount. Moreover, since the thermal cracking according to the present invention can be performed under normal conditions, the operation eminently excels in controllability.

The present invention will be described herein below with reference to a working example.

EXAMPLE

By using one, two and three reaction vessels respectively, a heavy petroleum oil (Residue of vacuum distillation of KHAFJI oil) was subjected to thermal cracking through the procedure illustrated in FIG. 5. The operating conditions involved, the yields of products obtained and the properties of the produced pitches are compared in Table 1.

As is evident from Table 1, the pitches from the operation of one reaction vessel had a larger content of quinoline insolubles than those from the operation of three reaction vessels and of four reaction vessels, with those from the operation of two reaction vessels being therebetween. This clearly shows that use of a plurality of reaction vessels arranged in series results in improved homogeneity of produced pitches.

As regards the operational efficiency, in the production of pitches having softening points over 160° C., the operation using one reaction vessel could not be continued for more than 10 hours because the reaction in the reaction vessel entailed coking and caused a mechanical trouble, whereas the operation using three reaction vessels could be easily continued for five days because the interior temperature of the second and third reaction vessels were successively lowered. When the three vessels used in the latter operation were disassembled after the operation and carefully inspected, no sign of abnormality was observed anywhere.

In addition, the system comprising four reaction vessels arranged in series was operated extremely smooth for more than three months without any troubles caused by coke formation and by fluctuation of the properties of the produced pitch. The pitch thus obtained in a quite stabilized operation was more aromatic and more uniform than the pitches produced in the two reaction vessels-system and in the three reaction vessels-system.

TABLE 1

| | Number of reaction vessels and properties of produced pitches | | |
|---|---|---|---|
| Number of reaction vessels | 1 | 2 | 3 |
| Operating conditions | | | |
| Flow rate of oil (kg/hr) | 300 | 300 | 300 |
| Outlet temperature of heating furnace (°C.) | 480 | 480 | 480 |

TABLE 1-continued

| | Number of reaction vessels and properties of produced pitches | | |
|---|---|---|---|
| Number of reaction vessels | 1 | 2 | 3 |
| Operating temperature of first reaction vessel (°C.) | 412 | 415 | 421 |
| Operating temperature of second reaction vessel (°C.) | — | 395 | 397 |
| Operating temperature of third reaction vessel (°C.) | — | — | 392 |
| Operating temperature of fourth reaction vessel (°C.) | — | — | — |
| Yields | | | |
| Cracked gas (wt %) | 3.5 | 3.3 | 3.4 |
| Cracked light oil (wt %) | 11.7 | 12.1 | 12.8 |
| Cracked heavy oil (wt %) | 54.2 | 53.8 | 53.8 |
| Pitches (wt %) | 30.6 | 30.8 | 30.3 |
| Properties of pitches | | | |
| Softening point | | | |
| from No. 1 vessel | 169 | 152 | 141 |
| form No. 2 vessel | — | 173 | 165 |
| from No. 3 vessel | — | — | 174 |
| from No. 4 vessel | — | — | — |
| Fixed carbon (wt %) | 58.0 | 57.2 | 56.1 |
| Heptane insolubles* (wt %) | 75.7 | 75.7 | 76.0 |
| Benzene insolubles* (wt %) | 55.1 | 51.1 | 48.9 |
| Quinoline insolubles* (wt %) | 25.3 | 18.4 | 15.8 |
| Ratio of H/C* | 0.80 | 0.79 | 0.78 |
| State of coking in reaction vessels | coking very severe | Adhesion of coke observed | Adhesion of coke scarcely observed |
| Actual volume of each reaction vessel ($m^3$) | | | |
| 1 | 1.4 | 0.8 | 0.4 |
| 2 | — | 0.3 | 0.3 |
| 3 | — | — | 0.1 |
| Total | 1.4 | 1.1 | 0.8 |

Note
(1): *Properties of the pitch from each of the last reaction vessel.
(2): The flow of material in the above-mentioned series of reaction vessels arranged in series was so controlled that in each reaction vessel the content (oil plus bubble) occupied 50% of the available internal volume of each reaction vessel, the ratio of the total volume of bubbles to the available internal volume of the reaction vessel being about 60%.

What is claimed is:

1. In the method for the thermal cracking of a heavy petroleum oil wherein the heavy petroleum oil is preheated to a temperature of 450° to 520° C. and introduced into a reaction system, where the heavy petroleum oil is then subjected to thermal cracking under conditions of a temperature of 350° to 450° C., a pressure of 300 mmHg to 15 kg/cm$^2$ and a residence time of 1 to 10 hours, the improvement wherein (a) the heavy petroleum oil is introduced into a reaction system comprising a plurality of reaction vessels arranged in series; and (b) the interior of each of said plurality of reaction vessels arranged in series is maintained at a temperature which is 5° to 50° C. lower than the interior temperature of the preceding reaction vessel by contacting the heavy petroleum oil in each vessel with a gaseous thermal medium which does not react with the oil at a temperature of 400° to 2000° C. and controlling the volume of the gaseous thermal medium introduced into each vessel, thereby suppressing the formation of coke on the inner walls of said reaction vessels and forming a high aromatic and uniform pitch of the ratio of H/C of 0.4 to 1.1, of a content of n-heptane-insoluble and quinoline-soluble fraction of more than 55% and of a softening point of about 170° C.

2. The method according to claim 1 wherein the number of said reaction vessels is 2 to 5.

3. The method according to claim 1, wherein the gaseous thermal medium is steam.

* * * * *